United States Patent [19]

Effenberger

[11] 4,402,647

[45] Sep. 6, 1983

[54] VISCOSITY IMPELLER

[76] Inventor: Udo E. Effenberger, 541 W. Park Ave., Tallahassee, Fla. 32301

[21] Appl. No.: 100,994

[22] Filed: Dec. 6, 1979

[51] Int. Cl.[3] ..... F01D 1/36

[52] U.S. Cl. ..... 415/90

[58] Field of Search ..... 415/90, DIG. 4; 416/179

[56] References Cited

U.S. PATENT DOCUMENTS

| | | | |
|---|---|---|---|
| 1,061,142 | 5/1913 | Tesla . | |
| 1,061,206 | 5/1913 | Tesla . | |
| 1,209,359 | 12/1916 | Tesla . | |
| 2,087,834 | 7/1937 | Brown et al. | 415/90 |
| 2,632,598 | 3/1953 | Wales . | |
| 3,902,045 | 8/1975 | Laing . | |
| 4,037,984 | 7/1977 | Rafferty et al. | 415/90 |

FOREIGN PATENT DOCUMENTS

| | | | |
|---|---|---|---|
| 2592 | 6/1979 | European Pat. Off. | 406/99 |
| 380992 | 9/1932 | United Kingdom . | |
| 1163340 | 9/1969 | United Kingdom . | |
| 1341923 | 12/1973 | United Kingdom . | |
| 1461776 | 1/1977 | United Kingdom . | |

OTHER PUBLICATIONS

Burton, W. E. "Make a Model Tesla Turbine" Popular Mechanics, Sep. 1965, pp. 188–193.

Rice, W. "An Analytical and Experimental Investigation of Multiple Disk Pumps and Compressors" Journal of Engineering for Power, Jul. 1963, pp. 191–200.

Hasinger et al. "Investigation of a Shear-Force Pump" Journal of Engineering for Power, Jul. 1963, pp. 201–206.

*Primary Examiner*—Louis J. Casaregola

*Attorney, Agent, or Firm*—Spencer & Kaye

[57] ABSTRACT

An improved vaneless fluid impeller of the friction type including a plurality of co-rotating axisymmetrical aligned spaced annular disks mounted for rotation about a common axis. Depending on whether a low kinematic viscosity or a high kinematic viscosity fluid is being utilized, the spacing between adjacent side surfaces of the disks decreases with increasing radial distance from the axis of rotation or increases with increasing radial distance from the axis of rotation, respectively, to provide increased energy transfer efficiency. The impeller with variable inter-disk spacing may be used either for radial flow directed outwardly or radial flow directed inwardly.

15 Claims, 5 Drawing Figures

VISCOSITY IMPELLER

BACKGROUND OF THE INVENTION

The present invention relates to an improved fluid handling device for providing a more efficient fluid flow. In particular, the present invention relates to an improved vaneless impeller for such devices, which impeller relies on the generation of frictional and rotational forces to propel or convey the fluid efficiently and to produce a desired pressure differential. The impeller may be rotationally driven so as to produce an accelerated fluid flow in a radially outward direction, in which case the device functions in the manner of a fluid pump, or the impeller may be non-driven with the fluid flow being directed radially inward, so that the device functions in the manner of turbine.

Centrifugal fluid conveying devices, and in particular, air pumps or blowers, utilizing a vaneless impeller for producing an accelerated radially outward fluid flow between co-rotating disks of the impeller are known in the art and the theoretical considerations of such devices have been extensively analyzed. In this regard, see for example, U.S. Pat. No. 1,061,142 issued May 6, 1913 to N. Tesla and the articles by W. Rice, "An Analytical and Experimental Investigation of Multiple Disk Pumps and Compressors", TRANSACTIONS OF THE ASME—JOURNAL OF ENGINEERING FOR POWER, July 1963, pp. 191–200, and S. H. Hasinger et al, "Investigation of a Shear-Force Pump", TRANSACTIONS OF THE ASME—JOURNAL OF ENGINEERING FOR POWER, July 1963, pp. 201–206. In such devices, the rotor or impeller is driven by a motor and is constructed of a series or plurality of coaxially spaced annular disks. Due to the annulus present in each disk, fluid is drawn in proximate the center of rotation and is subsequently propelled radially outwardly in a spiral path as dictated by the actions of two types of forces. These forces are the frictional forces imparted to the fluid by the side surfaces of the rotating disks and the centrifugal forces resulting from the angular motion of the disks. In all of the known devices of this type, each of the disks is provided with respective side surfaces which are straight and the disks are coaxially mounted so that the side surfaces of all disks are parallel. Consequently, in the known devices, the spacing between the facing side surfaces of adjacent pairs of disks is constant in the radial direction.

Although devices of this type have been known for some time, they have not been extensively used, in a practical sense, due to a low-efficiency. One major cause of the low-efficiency of such devices is the energy loss incurred in the vicinity of the disk annulus which is due to the lack of a smooth transistion from an axially directed fluid flow, i.e., along the axis of rotation of the impeller or rotor, to a radially directed flow between the rotating disks. In order to overcome this problem, it has previously been suggested to incline the straight and parallel disks with respect to the axis of rotation so that they face in the direction of the fluid inlet, or to curve the innermost portions of otherwise straight and parallel radially extending disks in the direction of the fluid inlet.

Although the reduction of the energy losses incurred in the vicinity of the disks provide an improvement in the efficiency of the above-mentioned type of device, i.e., the annular disk impeller or rotor, efforts to further improve or optimize the efficiency of such devices have continued. In this regard, it has been discovered that certain theoretical assumptions concerning the specific nature of the fluid flow dynamics between rotating disks and, additionally, assumptions concerning the corresponding optimum design of such disks do not agree with experimental findings. In particular, experimental test results have strongly indicated that the fluid boundary layers which form on rotating surfaces do not stabilize asymptotically with increasing radius as was heretofore believed, but rather they tend to vary along the entire radial distance. Thus, the straight and parallel disks do not allow for an optimal flow pattern, either in terms of flow output or with regards to efficiency.

SUMMARY OF THE INVENTION

It is a primary object of the present invention to provide an modified fluid flow conveying device of the type generally desribed above, i.e., a device including a rotor or an impeller having a plurality of coaxially mounted annular disks between which the fluid flows in a substantially radial direction, having an improved efficiency. The above object is achieved according to the present invention in that in an apparatus for producing an accelerated fluid flow including a housing defining a fluid flow path and having a fluid inlet and a fluid outlet, a motor and an impeller with the impeller having a hub coupled to the motor for rotation therewith and a plurality of axisymmetrical coaxially spaced annular disks fixedly mounted on the hub and disposed in the fluid flow path so that the interior openings of the plurality of disks form a fluid inlet channel for the impeller, and with each of the disks having a pair of side surfaces for exerting tangentially directed shear and radially directed centrifugal forces on the fluid proximate the side surfaces of the disks and flowing therebetween during rotation of the impeller; the side surfaces of the disks are smooth and the cross-sectional profiles of the disks are such that the spacing between facing ones of the side surfaces of the disks varies in the radial direction.

Preferably the variation in the spacing between facing side surfaces of adjacent disks is such that the optimal Reynolds number is maintained at all radial distances from the axis of rotation, so as to improve the efficiency of the impeller. In connection with the variation of the inter-disk spacing, it has been found that the same is particularly dependent on the kinematic viscosity of the particular fluid being conveyed. Although this would appear to require that the variation in the inter-disk spacing with radial distance be tailored to a specific fluid, it has been found that substantial improvements in the efficiency of the impeller can be achieved by generally either decreasing or increasing the inter-disk spacing with the radial distance from the axis of rotation depending on whether the fluid has a low kinematic viscosity or a high kinematic viscosity respectively.

More specifically, when low viscosity fluids, such as gases, (i.e., air,) are propelled through a multiple disk impeller, relatively small boundary layers are formed which, due to the rotational effects on such media, acquire an approximately maximal thickness nearer the inlet radius as the fluid is accelerated by the side surfaces of the disks. Accordingly, in order to maintain an optimal Reynolds number, as well as a favorable pressure differential, with respect to efficiency, the inter-disk spacing, when conveying such a fluid, should be greatest near the inner or inlet radius and should then decrease with increasing radial distance from the axis of rotation, i.e., the facing side surfaces of adjacent disks should converge with increasing radial distance. Preferably, in order to maintain the optimal Reynolds number with respect to efficiency at all radial distances, the interdisk spacing should be varied so as to maintain the circumferential or radial flow area between the facing side surfaces of the disks approximately constant with increasing radial distance. Under such conditions, the radial velocity of the fluid would likewise remain constant from the inlet to the periphery.

In contrast, when high kinematic viscosity fluids, such as heavy oils and sludges, are propelled through a multiple disk impeller, the maximum boundary layer tends to form at somewhat of a distance from the impeller inlet, and consequently the frictional forces should be permitted to somewhat dominate in order to provide an improved efficiency. Thus, when conveying a high kinematic viscosity fluid, the inner spacing between pairs of disks should be smallest proximate the axis of rotation and increase with increasing radial distance from the axis or rotation, i.e., the facing side surfaces of adjacent disks are relatively close together proximate the axis of rotation and then diverge with increasing radial distance.

Finally, although the invention is particularly applicable, as discussed above, to a fluid pump wherein the impeller is driven by a motor and the fluid flow is directed radially outwardly, the invention is likewise applicable to fluid conveying arrangements including a multiple annular disk impeller wherein the fluid flow is directed radially inwardly. That is, the present invention utilizing a multiple annular disk impeller with varying inter-disk spacing is also applicable to arrangements, such as turbines, wherein the fluid flow originates at the periphery of the disk assembly, imparts frictional forces onto the side surfaces of the disks in order to turn the impeller, and finally exits via the channel formed by the annuli of the disks. In the case of radially inwardly directed flow, and depending on whether a low kinematic viscosity or a high kinematic viscosity fluid were being utilized, the inter-disk spacing would vary relative to the axis of rotation in substantially the same manner as with a radial flow which was directed outwardly.

DETAILED DESCRIPTION OF THE PREFERRED EMBODIMENT

Figure 2:
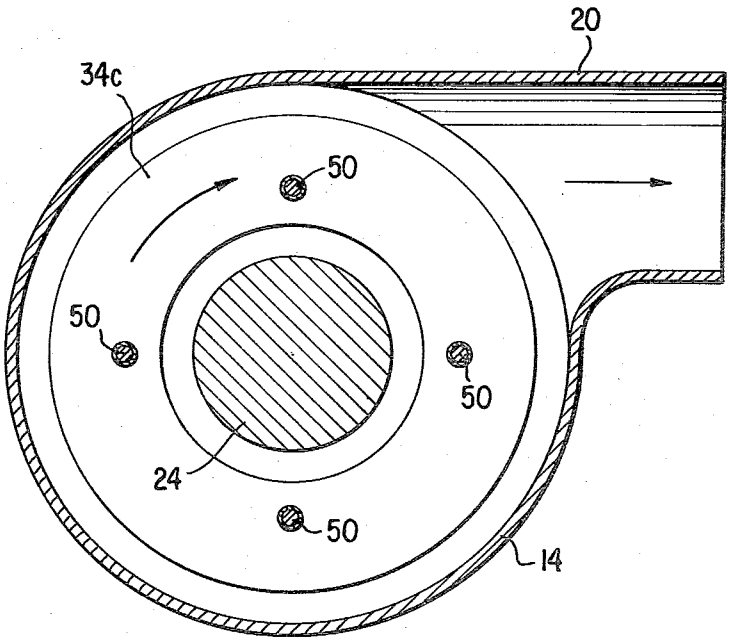
FIG. 2 is a cross-sectional elevation view of the centrifugal blower of FIG. 1 along the section II—II of FIG. 1.
Figure 1:
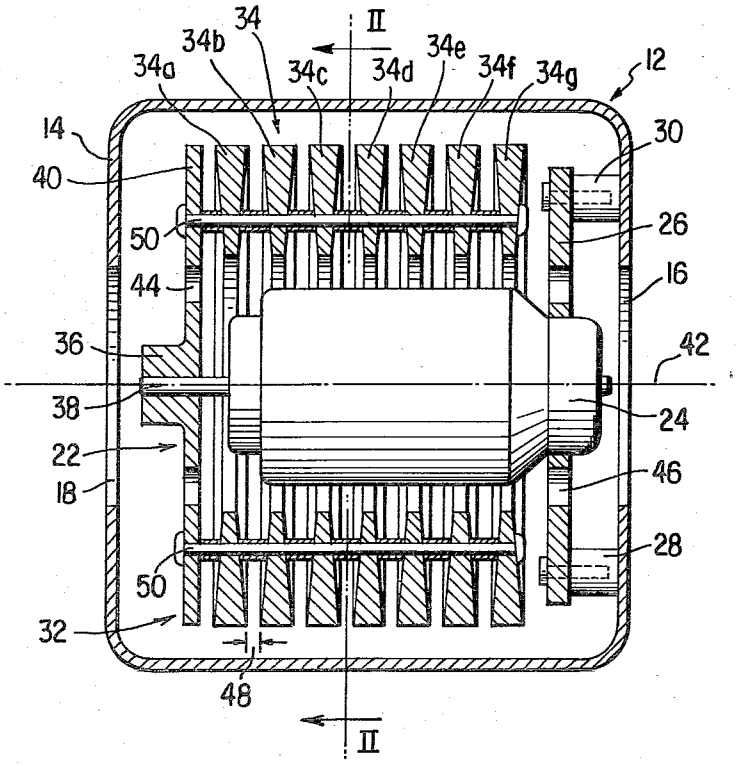
FIG. 1 is a cross-sectional end view of a centrifugal blower having a modified impeller according to one embodiment of the invention.

Referring now to FIGS. 1 and 2, there is shown a fluid pump, and in particular an air blower, including a housing 12 having a generally cylindrical section 14 which is provided with axially disposed inlet openings 16 and 18 and a peripherally disposed outlet or exhaust duct 20. Disposed within the cylindrical portion 14 of the housing 12 is an impeller 22 which is mounted for rotation on a motor 24. The motor 24 is positioned along the axis of the cylindrical housing section 14 and is fastened to the end wall of the cylindrical section 14 in a conventional manner. For example, as shown, the motor 24 is provided with a motor mounting plate 26 which is connected to the end wall of the section 14 via a plurality of bolts 28 which extend through spacers or bushings 30 formed of a vibration absorbing material.

The impeller 22 includes a hub 32 having a disk assembly 34 fixedly mounted thereon. The hub assembly 32 includes a collar 36 for a conventional engagement with the shaft 38 of the motor 24 to cause rotation of the hub 32 by the motor 24. The hub 32 additionally includes a circular plate 40 which is fixedly attached to the collar 36 and to which the disk assembly 34 is fixedly attached.

The disk assembly 34 includes a plurality of annular disks **34*a* to 34*g*, each of which is axisymmetrical, arranged in an axially spaced relationship with respect to one another and aligned on a common axis 42 for rotation with the hub 32**.

In the operation of the device thus far described, the the fluid to be conveyed in an accelerated manner enters the housing 12 via the axially disposed inlet openings 16 and 18 and enters the annular chamber 43 (formed in the interior of the disk assembly 34 as a result of the inner openings of the aligned individual disks **34*a* to 34*g*) via openings 44 and 46 provided in the hub plate 40 and motor mounting plate 26 respectively. Thereafter, as a result of the rotational frictional forces exerted on the fluid trapped between the rotating disks 34*a* to 34*g* by the side surfaces of same, and as a result of the radially directed centrifugal forces acting on the fluid due to rotation of the disk assembly, both a tangential velocity component and a radial velocity component are imparted to the fluid between the rotating disks. The resulting motion of the fluid is a radially outward axisymmetrical flow in the form of an outwardly expanding spiral, with the fluid particles exiting from the rotating disk assembly 34 at the periphery thereof having substantially only radial and tangential velocity components, and finally exiting the housing via the outlet 20**.

As pointed out above, it has been found that the interdisk spacing, i.e., the axial distance between facing side surfaces of adjacent disks, such as gap 48 between disks **34*a* and 34*b*, is important to the proper and efficient operation of a fluid conveying device thus far described. As was further pointed out above, it has been found that the efficiency of such a device can be improved by varying the inter-disk spacing with increasing radial distance from the axis of rotation 42** so as to provide the optimum Reynolds number at all radial distances, and that consequently the desired variation and the spacing is predominantly determined by the kinematic viscosity of the fluid being conveyed. In general, it has been found that, the inter-disk spacing should decrease with increasing radial distance from the axis of rotation for low kinematic viscosity fluids, such as gases including air, and increase with increasing radial distance from the axis of rotation for high kinematic viscosity fluids, such as heavy oils or sludges.

The embodiment of the invention shown in FIG. 1, is intended for the conveyance of a relatively low kinematic viscosity fluid, and in particular air, and therefore in accordance with the present invention, as shown, the interdisk spacing decreases with increasing radial distance from the axis of rotation 42. This is achieved in the illustrated embodiment by varying the thickness of the cross-sectional profile of the individual disks 34*a* to 34*g* from a minimum thickness at the smallest or inner radial distance ($R_I$) of the annular disks to a maximum thickness at the largest or outer radial distance ($R_O$), while maintaining the inter-disk axial spacing substantially constant.

In varying the inter-disk spacing so as to decrease same with increasing radial distance when conveying a low kinematic viscosity fluid, it is desired to maintain the radial flow area between adjacent disks with increasing radial distance from the axis of rotation as nearly constant as possible since it has been found that this results in an increased efficiency for a given number of disks, and in particular a greater volume of fluid can be moved per unit of power. This radial flow area ($A_{rf}$), which in conventional devices of the type to which the present invention is directed having straight and parallel disks is normally an increasing function of the radial distance R from the axis of rotation as a consequence of the relationship $A_{rf}=2\pi$ Rd, where d is the axial spacing between surfaces of adjacent disks at the radial distance R, is preferably maintained constant according to the present invention by varying the spacing d inversely with increasing radial distance R according to the equation: $d/d_I=R_I/R$, where $d_I$ is the spacing between facing side surfaces of adjacent disks at the smallest or inner radius of the disk $R_I$. Alternatively, and equivalently, the spacing d can vary inversely with increasing radial distance R from the axis of rotation according to the relationship or equation $d/d_o=R_O/R$, where $d_o$ is the spacing between facing side surfaces of adjacent disks at the largest or outer radius $R_O$ of the disks.

The above equation will yield side surface profiles for the individual disks 34*a* to 34*g* which are hyperbolic and may be uneconomical to manufacture on a mass production basis. Such hyperbolic profiles can be approximated, however, by setting both the innermost spacing $d_I$ and the outermost spacing $d_O$ to satisfy the above equations and by then varying the intermediate spacings in a linear fashion, so that the linear side surfaces as shown for the disks 34*a* to 34*g* will result. Alternatively, the spacings d at two intermediate radii can be set in accordance with the above equations to establish the linear or planar side surfaces profiles as shown in FIG. 1.

In order to maintain the proper inter-disk spacing, the disks 34*a* to 34*g* can be press-fitted on pin assemblies 50, which are fastened to the hub plate 40, using temporarily installed shims between the individual disks or can be slip-mounted on the pins 50 with permanent shim washers between adjacent disks. Alternatively, with individual disks 34*a* to 34*g* made of molded plastic, integral projections can be formed thereon which engage corresponding recesses in adjacent disks to align and properly space the disks. Moreover, the disks can be joined by ultrasonic welding or by use of a suitable adhesive. Finally, with a disk assembly 34 formed of a suitable plastic, the entire assembly can be injection molded.

Ideally, the individual disks 34*a* to 34*g* should be as thin as possible so as to maximize the number of disks, (and hence, the number of side surfaces imparting frictional forces to the fluid) per unit length along the axis of rotation 42. The minimum thickness of the disks 34*a* to 34*g* should be such as to maintain the structural integrity of the disks, with the appropriate safety margins, at the contemplated speeds of rotation. This minimum thickness is also a function of the inherent strength of the material used for the individual disks 34*a* to 34*g* and can readily be determined by known techniques. The material used can be, for example, a metal, or, as indicated above, a plastic material.

As an example of the present invention, a device such as shown in FIGS. 1 and 2 with individual annular disks having an inner diameter of approximately 2 inches and an outer diameter of approximately 4 inches, for rotation at a speed between 6,000 and 18,000 rpm was utilized for providing an accelerated flow of air. In such a use, it was found that the spacing between the facing side surfaces of adjacent disks had to be maintained such that the spacing $d_O$ at the outer disk radius $R_O$ was greater than about 0.010 inches and such that the spacing $d_I$ at the inner disk radius $R_I$ was less than about 0.075 inches. Outside of these spacing limits, degradation in impeller performance was found to occur.

In the embodiment of FIG. 1, the variation in the spacing between the adjacent side surfaces is achieved by utilizing a plurality of similar disks which are uniformly axially spaced and by varying the thickness of the cross-sectional profile of same. It is to be understood, however, that any arrangement which will satisfy the desired variation in the inter-disk spacing may be utilized. For example, the variation in the inter-disk spacing can be accomplished by providing a succession of disks of uniform thickness with increasing concavity. Additionally, disks of uniform thickness and having parallel side surfaces may be utilized alternately with disks whose cross-sectional profile varies so long as the net effect is the reduction of the radial flow area between facing side surfaces of adjacent disks with increasing radial distances.

Figure 3:
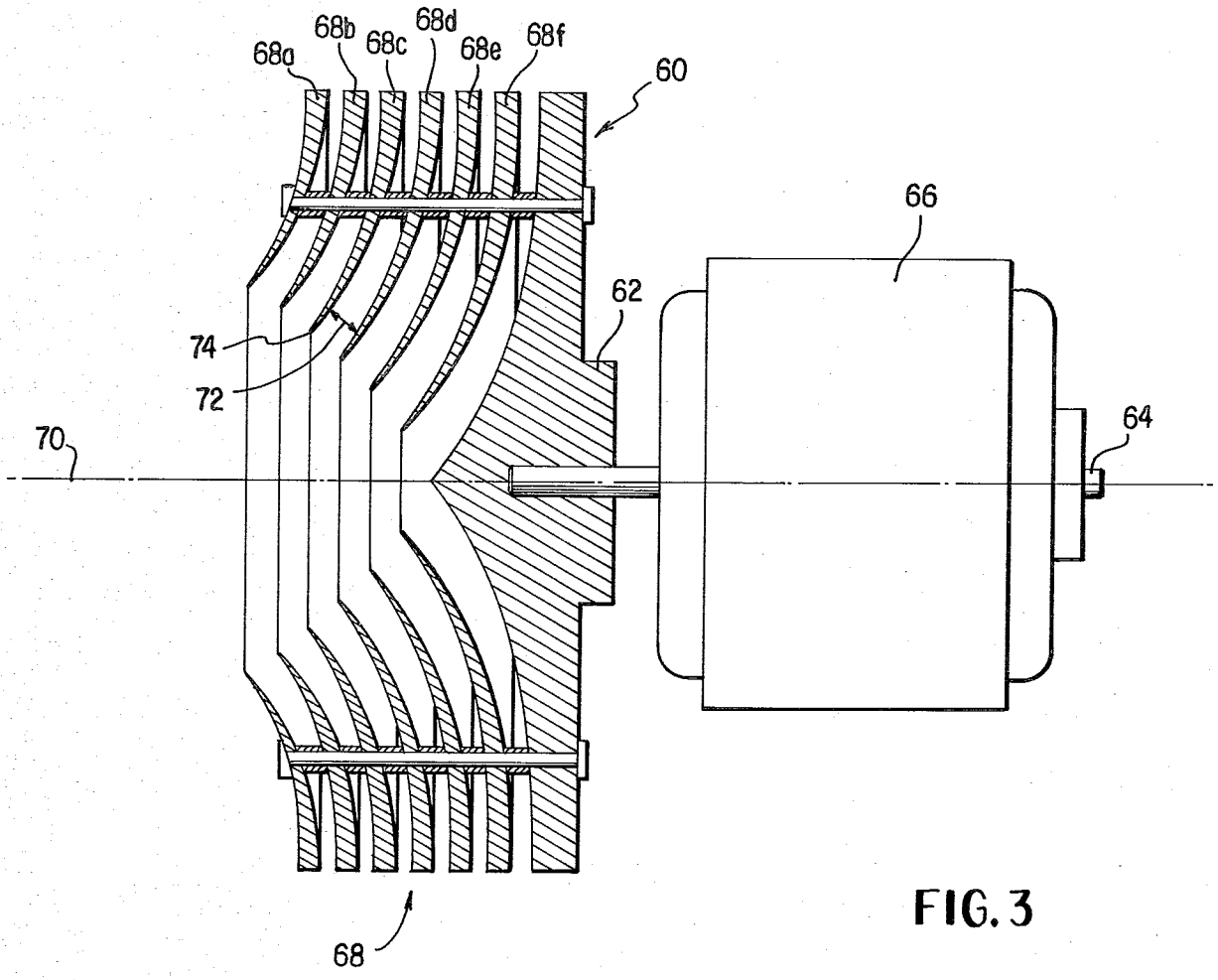
FIG. 3 is a schematic sectional view of a further embodiment of an impeller according to the invention for use with low kinematic viscosity fluids.

FIG. 3 shows a modification of the impeller of FIG. 1 for use with low kinematic viscosity fluids which can provide an even greater increase in operating efficiency that that of FIG. 1. As shown, the impeller 60 includes a hub 62 for mounting the impeller on the shaft 64 of a motor 66, and a disk assembly 68 including individual annular disks 68*a* to 68*f*. The individual disks 68 can be mounted on the hub 62 with pin assemblies similar to that shown in the embodiment of FIG. 1, or can be integrally formed with the hub 62. Although only six disks 68 are shown, it is to be understood that, as with all other disclosed embodiments, any number of disks may be utilized depending on the specific application for which the impeller is intended.

As with the embodiment of FIG. 1, the individual annular disks 68*a* to 68*f* are axisymmetrically aligned and spaced along the rotation axis 70 of the motor shaft 64 to provide flor paths between the facing side surfaces of adjacent disks. Contrary to the embodiment of FIG. 1, in this embodiment the disks 68*a* to 68*f* do not simply extend in a radial direction, but are provided with cross-sectional profiles which define smooth curves. However, the curves are such that the flow paths at the outer periphery of the disk assembly 60 has components which are substantially radial and tangential to the axis of rotation 70 with little or no axial component. In order to provide an additional flow path, the inner surface of the hub 62 is extended along the axis 70 to provide an additional flow surface facing one surface of the disk 68*f*.

As with the embodiment of FIG. 1, the spacing between facing side surfaces of the disks 68*a* to 68*f* is varied so that it decreases with increasing radial distance from the axis of rotation 70 in a manner so as to maintain the radial flow area constant at all radial distances. Preferably, as likewise discussed with regard to the embodiment of FIG. 1, the spacing 72, i.e., the axial distance between adjacent disks, varies inversely with the radial distance from the axis of rotation 70.

As shown in FIG. 3, the variation in the inter-disk spacing is again achieved by varying the thickness of the cross-sectional profile of the individual disks 68*a* to 68*f* such that the thickness increases with increasing radial distance. It is to be understood, however, the spacing can likewise be varied by varying the concavity of the disk, or by a combination of varying the thickness and the concavity.

In the embodiment of FIG. 3, as shown, the innermost portion of each of the disks 68*a* to 68*f*, for example the innermost portion 74 of disk 68*b* is inclined with respect to the axis of rotation 70 and curved in the direction of the fluid inlet, which in the embodiment of FIG. 3 would be to the left. The inclination is such that the side surfaces of the individual disks from a smooth curve so as to provide a smooth transition from the axial flow of the inlet fluid to a radial flow. This smooth transition from axial to radial flow as a result of the inclination of the innermost portion of the individual disks tends to reduce the substantial turning losses inherent in devices with purely radial extending disks, and thus further increase the efficiency of the impeller. Additionally, as a result of the curvature of the individual disks 18*a* to 18*f*, a greater disk side surface area is provided for a given outer diameter. This permits for either a greater pressure buildup in the impeller, or for a reduction in the number of disks required for a given application.

Preferably, as further shown in FIG. 3, the innermost radii of the individual disks are varied in order to provide compensation for the decrease in the volumetric flow rate past successive disks as a result of the inlet flow intercepted by upstream disks. This is achieved, as shown, by decreasing the inner radius of the disks 68*a* to 68*f* with increasing axial distance from the source of inlet air, i.e., by providing the disk 18*a* with the largest inner radius and the disk 18*f* with the smallest inner radius.

Figure 4:
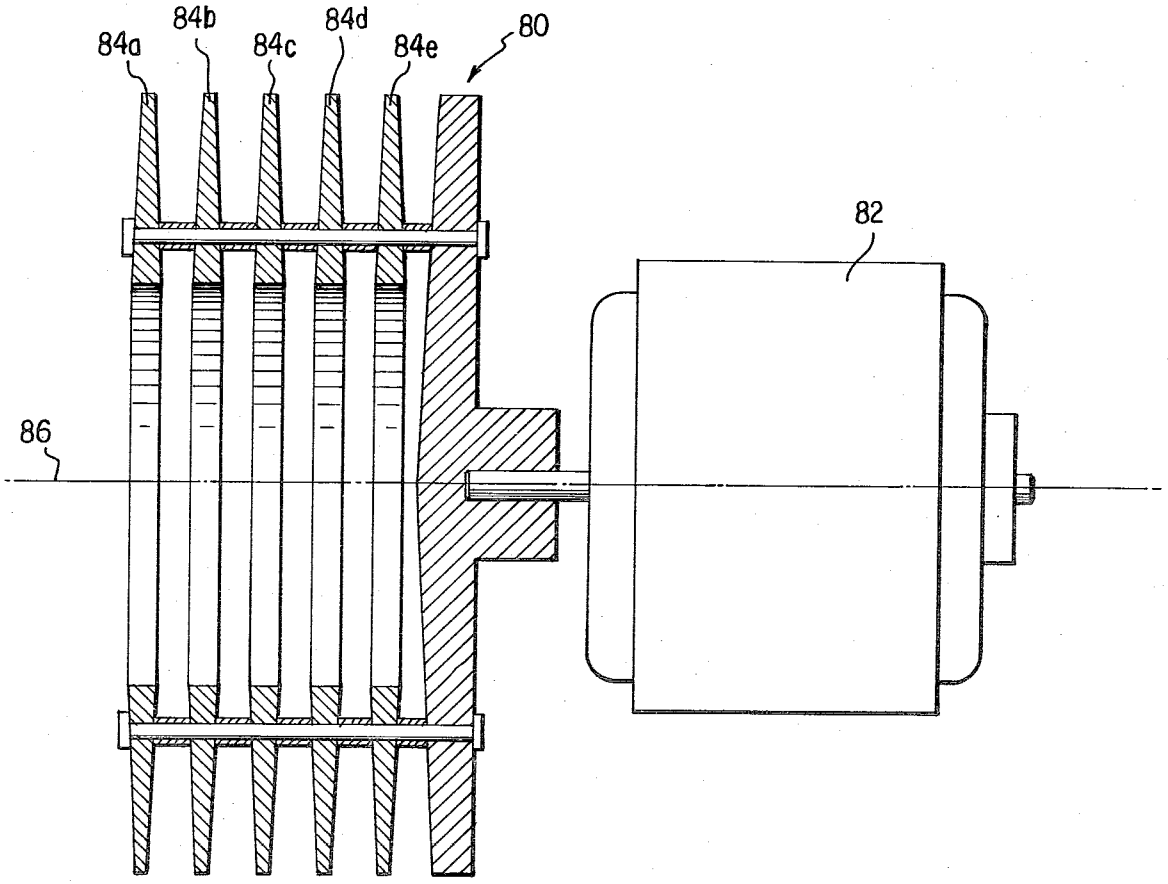
FIG. 4 is a schematic sectional view of an embodiment of an impeller according to the invention for use with high kinematic viscosity fluids.

Turning now to FIG. 4, there is shown an embodiment of an impeller according to the invention for use with high kinematic viscosity fluids such as heavy oils or sludges. Although schematically shown, the impeller 80 of FIG. 4 is constructed similarly to the impeller 22 of FIG. 1 with the minor difference that the motor 82 is not disposed within the annular cavity formed by the plurality of spaced coaxially aligned disks 84*a* to 84*e*, and with the more important difference that the cross-sectional profiles of the disks 84*a* to 84*e* produce a different variation in the spacing between facing side surfaces of adjacent disks 84*a* to 84*e*.

As previously pointed out, in order to improve the efficiency of an impeller of the type to which the present invention is direction when utilizing same to convey a high kinematic viscosity fluid, the inter-disk spacing is varied so as to provide the optimal Reynolds number at all radial distances from the axis of rotation. Generally, this is achieved when conveying a high kinematic viscosity fluid by increasing the spacing between facing side surfaces of adjacent disks, for example, between the facing side surfaces of the disks 84*a* and 84*b*, with increasing radial distance from the axis of rotation 86. Preferably, the axial spacing between the facing side surfaces of the adjacent disks is varied directly with the radial distance from the axis of rotation 83. This is achieved in the embodiment of FIG. 4 by varying the thickness of the cross-sectional profile of individual disks 84*a* to 84*e*, which extends substantially in the radial direction, so that the thickness varies from a maximum at the inner radii to a minimum at the outer radii or periphery of the impeller 80.

Figure 5:
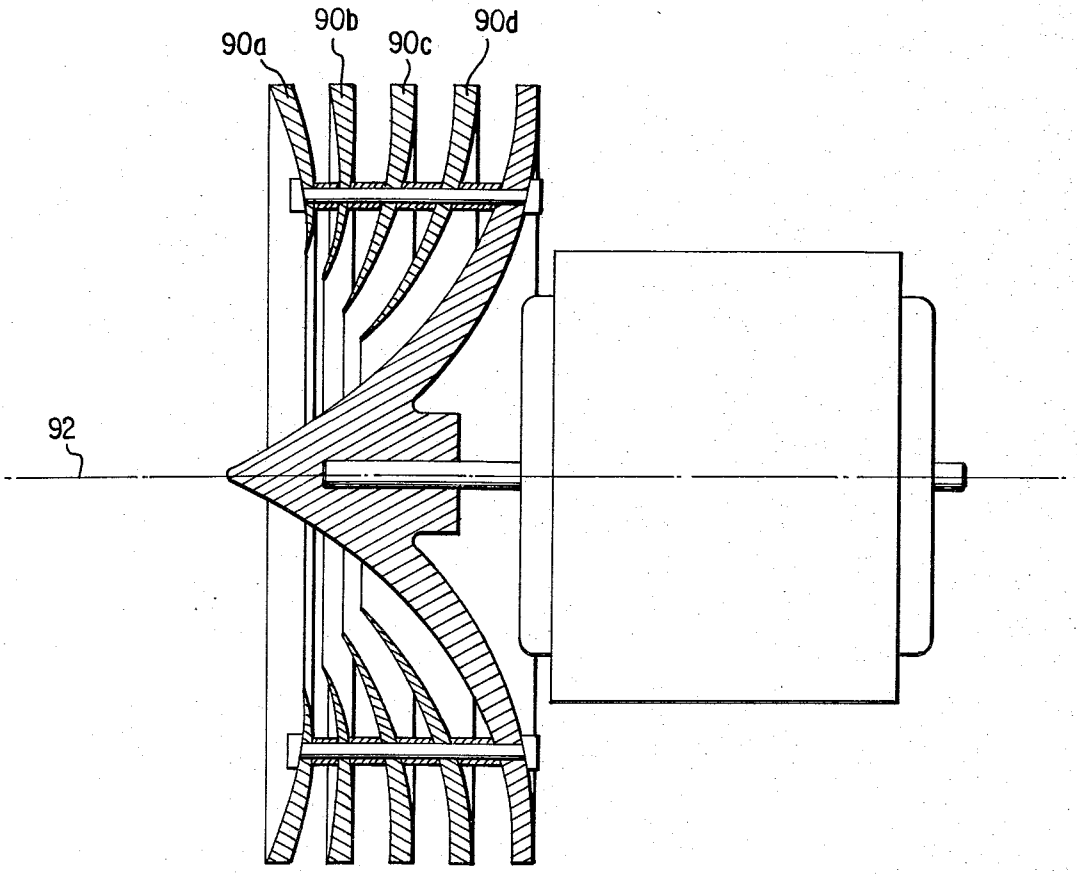
FIG. 5 is a schematic cross-sectional view of a further embodiment of an impeller according to the invention for use with high kinematic viscosity fluids.

Finally, FIG. 5 shows the manner in which the impeller arrangement of FIG. 3 may be modified in order to use same to convey a high kinematic viscosity fluid. Again, the individual aligned annular disks 90*a* to 90*d* are provided with side surfaces which are smoothly curved in the direction of the fluid inlet so as to provide for a smooth transition from the axial to the radial flow, and thus reduce the turning losses. However, contrary to the embodiment of FIG. 3, since the embodiment of FIG. 5 is intended for use with a high kinematic viscosity fluid, the spacing between facing side surfaces of adjacent disks is to increase with increasing radial distance from the axis of rotation 92. This is achieved in the embodiment of FIG. 5 by a combination of the variation in the thickness of the cross-sectional profile of the individual disks 90*a* and 90*d*, and the variation in the concavity of the individual disks. Thus, while as shown the thickness of the individual disks 90*a* to 90*d* increases with increasing radial distance from the axis of rotation 92, the concavity of the disks likewise increases from disk 90*a* to 90*d*. The net result of this increase in the concavity is that the spacing increases in the radially outward direction as desired for a high kinematic viscosity fluid.

In all of the embodiments of the invention discussed above, the impeller according to the invention has been utilized in a device providing a radially outward flow, and in particular for propelling or producing an accelerated fluid flow in a radial outward direction such as a fluid pump or air blower. The principle of the friction type multiple disk impeller, however, is also applicable for use in fluid conveying devices wherein a radially inwardly directed fluid flow is utilized. For example, a multiple annular disk impeller of the friction type can be used as the impeller of a turbine when the fluid flow originates under pressure at the periphery of the disk assembly and imparts frictional forces onto the side surfaces of the disks in order to turn the impeller and finally exits via the channel or chamber formed by the annuli of the disks. The use of such a multiple disk impeller of the friction type with flat disks and parallel side surfaces is disclosed and described in U.S. Pat. No. 1,061,206 issued May 6, 1913 to N. Tesla. With appropriate adjustments, all principles of design that pertain to the conveyance of radially outward fluid flow have equal applicability to the mechanical conveyance of radially inward flow, and accordingly, the impeller according to the invention with varying inter-disk spacing depending primarily upon the kinematic cosity of the fluid being conveyed is likewise applicable when using radially inward flow.

When utilizing a multiple disk impeller according to the invention for radially inwardly directed flow, for example in a turbine, utilizing a low kinematic viscosity fluid such as air or steam, it has been found that in order to provide the desired increased efficiency, the spacing between facing side surfaces of adjacent disks of the impeller should increase with increasing radial distance form the fluid inlet. However, since with a radially inwardly directed flow, the inlet is located at the outer periphery of the disk assembly, the net effect is that the inter-disk spacing decreases with increasing radial distance from the axis of rotation. Thus, essentially the same impeller configurations with the same variations in the inter-disk spacing can be utilized with low kinematic viscosity fluids regardless of whether inwardly directed or outwardly directed fluid flow is utilized. Consequently, although certain minor modifications in the structure may be required, the embodiment of the invention shown in FIGS. 1 and 2 could essentially likewise be utilized as a turbine having an impeller according to the invention with a varying inter-disk spacing simply by reversing the direction of flow. That is, the low kinematic viscosity fluid would simply be introduced via the duct 20, which would now serve as an inlet, and exit the housing via the inlet opening 16 and 18. Of course, in such case, the direction of rotation of the impeller would be reversed, and the motor 24 would either not be present, or replaced for example, by a generator which would be driven by the impeller. The impeller of FIG. 3 with its decreasing inter-disk spacing with increased radial distance from the axis of rotation could likewise be used for inwardly directed radial flow with a low kinematic viscosity fluid to produce an increased efficiency over an impeller with annular disks having straight and parallel side surfaces.

In a similar manner, the impeller arrangements according to the invention shown in FIGS. 4 and 5 could be used in a turbine to provide an inwardly directed radial flow of a high kinematic viscosity fluid such as a heavy oil.

It is to be understood that the term high kinematic viscosity fluid, as used in this application, means a fluid having a kinematic viscosity of at least 80 and preferably 100 centistokes at standard temperature conditions. Such a fluid, may for example, be a heavy mineral oil.

It will be understood that the above description of the present invention is susceptible to various modifications changes and adaptations, and the same are intended to be comprehended within the meaning and range of the equivalents of the appended claims.

What is claimed is:

1. In an apparatus for producing an accelerated fluid flow including a housing defining a fluid flow path and having a fluid inlet and a fluid outlet, a motor, and an impeller, said impeller having a hub coupled to said motor for rotation thereby and a plurality of axisymmetrical, coaxially spaced, annular disks, fixedly mounted on said hub, and disposed in said fluid flow path with the interior openings of said plurality of disks forming a fluid inlet channel for the impeller, each of said disks having a pair of side surfaces for exerting shear and centrifugal forces on the fluid proximate said surfaces and flowing between said disks during rotation of said impeller; the improvement wherein: the fluid to be accelerated is a low kinematic viscosity fluid; said side surfaces are smooth; and the cross-sectional profiles of said disks are such that the spacing between facing ones of said side surfaces of adjacent disks decreases with increasing distance from the axis of rotation of said impeller so as to maintain the radial flow area between facing side surfaces substantially constant with increasing radial distance from said axis of rotation.

2. The apparatus of claim 1 wherein the spacing between facing ones of said side surfaces varies inversely with the radial distance from said axis of rotation.

3. The apparatus of claim 1 wherein said low kinematic viscosity fluid is a gas.

4. The apparatus of claim 2 wherein said low kinematic viscosity fluid is air.

5. The apparatus of claim 4 wherein said spacing is greater than approximately 0.010" at the outer radii of said annular disks and less than approximately 0.075" at the inner radii of said disks.

6. In an apparatus for producing an accelerated fluid flow including a housing defining a fluid flow path and having a fluid inlet and a fluid outlet, a motor, and an impeller, said impeller having a hub coupled to said motor for rotation thereby and a plurality of axisymmetrical, coaxially spaced, annular disks, fixedly mounted on said hub, and disposed in said fluid flow path with the interior openings of said plurality of disks forming a fluid inlet channel for the impeller, each of said disks having a pair of side surfaces for exerting shear and centrifugal forces on the fluid proximate said surfaces and flowing between said disks during rotation of said impeller; the improvement wherein: the fluid to be accelerated is a low kinematic viscosity fluid; said side surfaces are smooth; and the thickness of said disks varies in the radial direction to cause the spacing between facing ones of said side surfaces of adjacent disks to decrease with increasing distance from the axis of rotation of said impeller.

7. The apparatus of claim 4 or claim 6 wherein each of said side surfaces is planar and wherein the variation in said spacing between facing ones of said side surfaces is determined by the radial distance at two specific radial distances.

8. The apparatus of claim 7 wherein said two specific radial distances are the inner and outer radii of said annular disks.

9. The apparatus as defined in claim 6 wherein said side surfaces of said disks form smooth curves and wherein at least the inner portion of each of said disks is inclined with respect to said axis of rotation and in a direction toward said fluid inlet of said housing.

10. In a fluid flow device including a housing defining a fluid flow path and having a fluid inlet and a fluid outlet, and an impeller, said impeller having a rotatably supported hub, and a plurality of axisymmetrical coaxially spaced annular disks fixedly mounted on said hub and disposed in said fluid flow path so that said fluid flow path includes the space between adjacent ones of said disks and the channel along the axis of rotation of the impeller formed by the interior openings of said plurality of disks; the improvement wherein the side surfaces of said disks are smooth and the cross-sectional profiles and axial spacing of said disks are such that the spacing between facing ones of the side surfaces of adjacent disks continuously varies in the radial direction so as to maintain the radial flow area between the facing side surfaces substantially constant with increasing radial distance from said axis of rotation.

11. The apparatus defined in claim 10 wherein said impeller is to be used with low kinematic viscosity fluids; and wherein said spacing between facing ones of the side surfaces of adjacent disks decreases with increasing radial distance from the axis of rotation of said impeller.

12. In a fluid flow device including a housing defining a fluid flow path and having a fluid inlet and a fluid outlet, and an impeller, said impeller having a rotatably supported hub, and a plurality of axisymmetrical coaxially spaced annular disks fixedly mounted on said hub and disposed in said fluid flow path so that said fluid flow path includes the space between adjacent ones of said disks and the channel along the axis of rotation of the impeller formed by the interior openings of said plurality of disks; the improvement wherein said impeller is to be used with low kinematic viscosity fluids; the side surfaces of said disks are smooth; the cross-sectional profiles and axial spacing of said disks are such that the spacing between facing ones of the side surfaces of adjacent disks continuously decreases with increasing radial distance from the axis of rotation of said impeller; and the thickness of at least some of said disks increases with increasing radial distance from the axis of rotation of said impeller in order to provide said spacing.

13. The apparatus defined in claim 11 or claim 12 further comprising a motor coupled to said hub for rotating said impeller; and wherein said fluid inlet and said fluid outlet are disposed such that fluid enters said impeller via said channel along the axis of rotation of said impeller and exits said impeller at the outer periphery of said disks.

14. The apparatus defined in claim 11 or claim 12 wherein said fluid inlet and said fluid outlet are disposed such that fluid enters said impeller at the outer periphery of said disks and exits said impeller via said channel along the axis of rotation of said impeller.

15. The apparatus defined in claim 1, claim 10 or claim 11 wherein the thickness of at least some of said disks increases with increasing radial distance from the axis of rotation of said impeller in order to provide said spacing.

* * * * *